United States Patent [19]

Coleman

[11] Patent Number: 4,776,043

[45] Date of Patent: Oct. 11, 1988

[54] HAT AND LOGO

[76] Inventor: Richard E. Coleman, 2595 Brookhaven Dr., Santa Rosa, Calif. 95405

[21] Appl. No.: 129,361

[22] Filed: Nov. 27, 1987

Related U.S. Application Data

[63] Continuation of Ser. No. 882,097, Jul. 3, 1986, abandoned.

[51] Int. Cl.[4] ..... A42B 1/02

[52] U.S. Cl. ..... 2/199; 2/185 R; 2/244:DIG. 6; 40/329

[58] Field of Search ..... 2/199, 185 R, 186, 196, 2/DIG. 6, 244; 40/329

[56] References Cited

U.S. PATENT DOCUMENTS

| | | | |
|---|---|---|---|
| 799,997 | 9/1905 | MacLellan | 40/329 X |
| 929,240 | 7/1909 | Novoson | 2/199 X |
| 1,295,280 | 2/1919 | Deason | 40/329 |
| 2,803,829 | 8/1957 | Tscharner | 2/199 X |
| 3,484,974 | 12/1969 | Culmone | 2/DIG. 6 |
| 3,895,797 | 7/1975 | Moore | 2/185 R X |
| 4,555,435 | 11/1985 | Walter | 2/DIG. 6 |
| 4,611,355 | 9/1986 | Galanto et al. | 2/DIG. 6 |
| 4,627,110 | 12/1986 | Tengs | 2/244 |

*Primary Examiner*—Louis K. Rimrodt
*Assistant Examiner*—J. L. Olds
*Attorney, Agent, or Firm*—Larry D. Johnson

[57] ABSTRACT

The present invention provides an improved hat with interchangeable patches that can be selectively attached to the hat. In the preferred embodiment, the hat is a standard, billed, baseball-style cap with some portion of a phrase or logo printed on its front surface, and a strip of fastening material or adhesive secured to the hat just below the incomplete phrase. A plurality of separate patches, each printed with a different completion to the hat's printed phrase or logo, and each with a back surface that is attachable to the fastening material on the hat, is provided. Thus the user can select the completion of the phrase with the patch of his choice. In this way a single hat can be used to carry a variety of different, and changing, phrases and logos.

8 Claims, 1 Drawing Sheet

HAT AND LOGO

This is a continuation of application Ser. No. 882,097, filed July 3, 1986, now abandoned.

BACKGROUND OF THE INVENTION

1. Field of the Invention

This invention relates generally to wearing apparel, and more specifically to hats and related headware.

2. Description of the Prior Art

Hats and other headware have become increasingly popular in recent years. In particular, casual "baseball-cap" style sporting hats are versatile, easily adjustable, and useful for protecting the wearer's eyes from sunlight or rain. Many such hats are decorated with screen-printed or embroidered names, logos, or other "message", and are similar in popularity to screen-printed t-shirts. Another significant reason for the popularity of these hats is that the hats themselves are worn by professional (and not so professional) athletes in many team sports, and fans and supporters of these teams regularly wear caps adorned with their favorite team's name and/or logo. In fact, sales of screen printed and embroidered hats and caps is a big business, both at retail stores and as concession sales at sporting events.

SUMMARY OF THE INVENTION

The present invention provides an improved hat with interchangeable patches that can be selectively attached to the hat. In the preferred embodiment, the hat is a standard, billed, baseball-style cap with some portion of a phrase or logo printed on its front surface, and a strip of fastening material or adhesive secured to the hat just below the incomplete phrase. A plurality of separate patches, each printed with a different completion to the hat's printed phrase or logo, and each with a back surface that is attachable to the fastening material on the hat, is provided. Thus the user can select the completion of the phrase with the patch of his choice. In this way a single hat can be used to carry a variety of different, and changing, phrases and logos.

A useful application of such an interchangeable logo system occurs when it is desirable to juxtapose only two elements of a given set of elements at a time, as, for example, with two sports teams in a league. By printing the hat with only one of the elements of the set (one team of interest in a league), and providing sufficient patches to include all the remaining elements of the set (the rest of the teams in the league), the patches can be applied to the hat as appropriate over the course of a competitive season, to illustrate any conceivable competition that could take place for that team of interest.

DETAILED DESCRIPTION OF A PREFERRED EMBODIMENT

Figure 1:
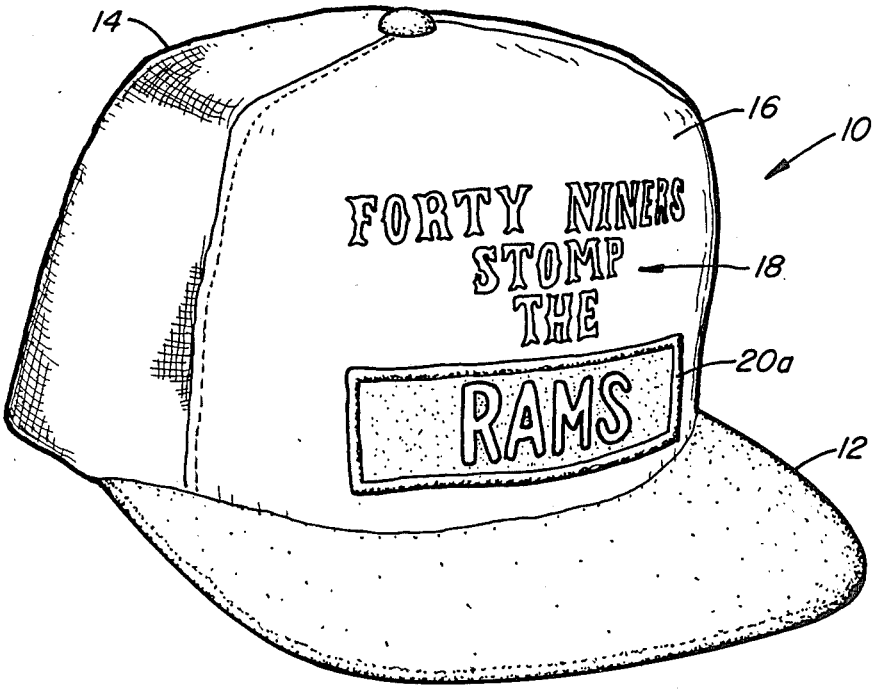
FIG. 1 is a perspective view of the hat and logo of this invention.

The hat and logo of this invention is illustrated in perspective view in FIG. 1. A hat 10 is preferably a standard, adjustable, billed baseball-style cap made of fabric, plastic, or other appropriate material. Hat 10 includes a brim or bill 12, which serves as a shade and visor for the wearer, and a crown or top 14. A front surface or brow 16 of the top of the hat is screen-printed or embroidered with markings constituting a portion of a phrase or a logo 18. A patch 20*a*, bearing markings constituting some appropriate word or logo to complete the incomplete phrase 18, is attached to the brow of the hat just below the phrase.

Figure 2:
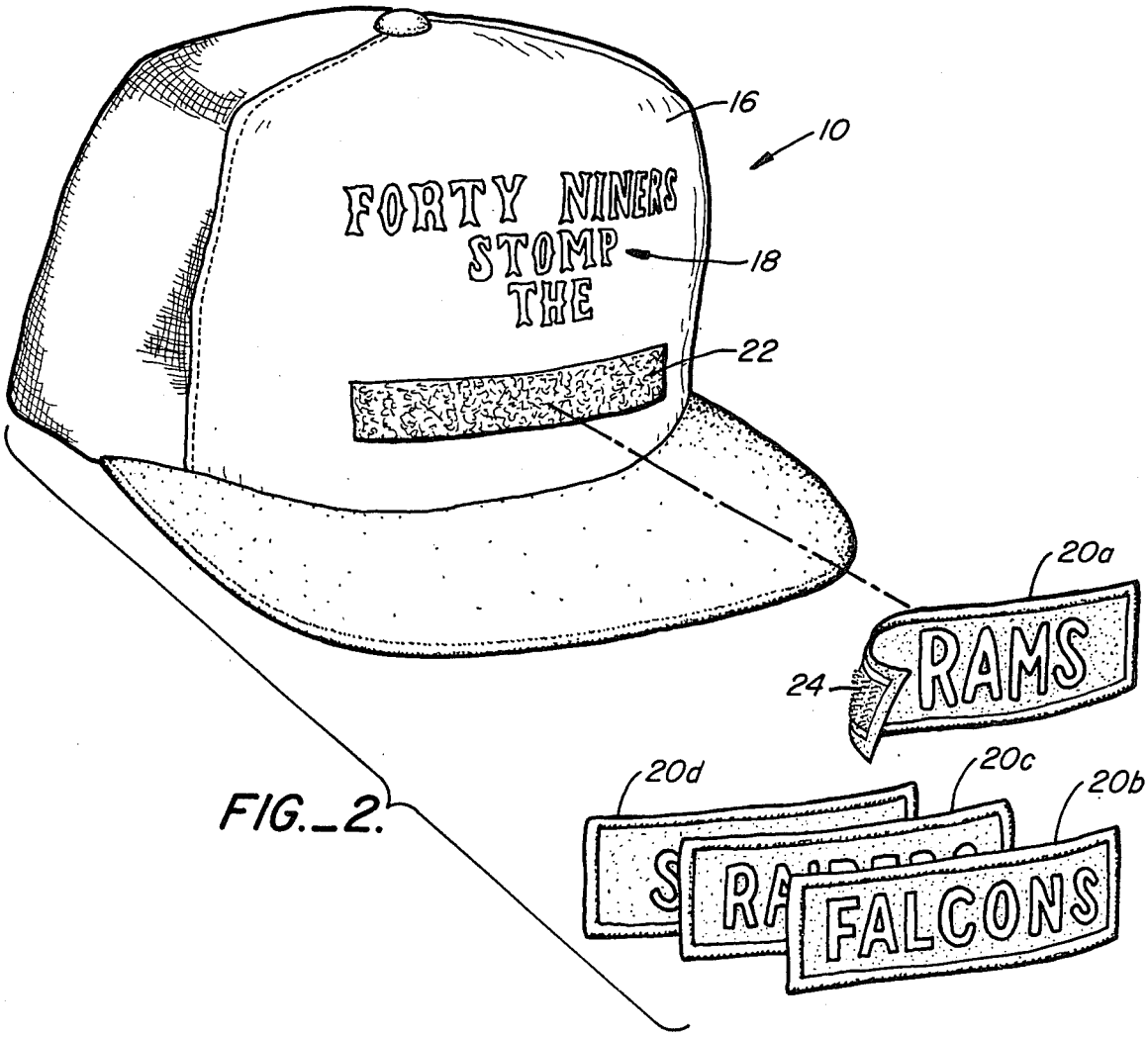
FIG. 2 is an exploded perspective view of the hat and logo of this invention, illustrating the interchangeability of the logo-bearing patches.

Referring now to FIG. 2 with greater particularity, the hat and logo of this invention is illustrated in exploded perspective view. Here, patch 20*a* is shown removed from hat 10, revealing a strip 22 of the "loop" portion of a hook-and-loop fastener system attached to the brow 16 just below the incomplete phrase 18. The back side of patch 20*a* is covered with a strip 24 of the "hook" portion of the fastener system, so that patch 20*a* can be readily attached to and detached from strip 22.

A series of separate patches 20*b*, 20*c*, and 20*d* are also provided, each bearing some alternate word or logo to complete the incomplete phrase printed on the hat. Thus, in the illustrated example, a user could selectively complete the phrase "Forty Niners Stomp The . . . "with "Rams", "Falcons", or some other team's name. By appropriate combination of the phrase printed on the hat with the words printed on the separate patches, a user could have just one hat that would be suitable for any potential competition that his favorite team would face. Here, for example, by including a selection of patches bearing the names of all of the National Football League teams, a single hat printed with "Forty-Niners Stomp The . . . "could be modified over the course of a football season to be used by a Forty-Niner fan at every game, up to and including the Super Bowl.

While this invention has been described in connection with preferred embodiments thereof, it is obvious that modifications and changes therein may be made by those skilled in the art to which it pertains without departing from the spirit and scope of the invention. For example, both portions of the phrase could be printed on removable patches, thereby exponentially increasing the variety of possible combinations. Furthermore, any type of fastening means could be employed to attach the patches to the hat, such as snaps, mild adhesives, and the like. Accordingly, the scope of this invention is to be limited only by the appended claims.

What is claimed as invention is:

1. A hat and logo combination comprising:

a hat member having at least one surface, said hat surface bearing first permanent markings constituting only a portion of a phrase;

at least one patch member bearing second permanent markings constituting completion of said phrase; and fastening means for removably attaching said patch member to said hat surface so that said second markings are discernible adjacent said first markings to complete said phrase.

2. The hat and logo combinatin of claim 1 wherein said hat has a front surface, and said first permanent markings are printed on said front surface.

3. The hat and logo combination of claim 2 wherein said fastening means comprises a hook-and-loop fastener system.

4. The hat and logo combination of claim 3 wherein said front surface carries a first strip of one material of a hook-and-loop fastener system, and said patch carries a second strip of the other material of said fastener system.

5. The hat and logo combination of claim 4 wherein said first strip is attached to said front surface immediately below said first permanent markings.

6. The hat and logo combination of claim 1 including a plurality of patch members, each patch member bearing different markings constituting an alternate completion of said phrase.

7. The hat and logo combination of claim 1 wherein said hat comprises a baseball cap.

8. A hat logo system comprising a hat member bearing permanently printed indicia identifying a single element of a set of related elements, and a plurality of patch members each bearing permanently printed indicia identifying a different remaining element of said set of elements, so that all the elements of said set are indicated on a separate member, and including fastening means for removably attaching only one patch member at a time to said hat so that the element indicia of said attached patch is juxtaposed with the element indicia of said hat.

* * * * *